US005222609A

United States Patent [19]

Eaton

[11] Patent Number: 5,222,609

[45] Date of Patent: Jun. 29, 1993

[54] DISPLAY APPARATUS

[76] Inventor: Peter R. K. Eaton, 112 Main North Road, Clare, South Australia, 5453, Australia

[21] Appl. No.: 904,457

[22] Filed: Jun. 26, 1992

[51] Int. Cl.[5] ..... A47F 5/00

[52] U.S. Cl. ..... 211/55; 40/124.2

[58] Field of Search ..... 211/55, 56, 128, 50; 40/124.2

[56] References Cited

U.S. PATENT DOCUMENTS

| | | | |
|---|---|---|---|
| 2,909,287 | 10/1959 | Galassi | 211/55 |
| 3,507,064 | 4/1970 | Hammero | 40/124.2 |
| 4,062,452 | 12/1977 | Bartholomew | 211/55 |
| 4,081,080 | 3/1978 | Rorex | 211/55 |
| 4,083,456 | 4/1978 | Genn et al. | 211/55 |
| 4,162,014 | 7/1979 | Bobrick | 211/50 |
| 4,579,232 | 4/1986 | Fedak | 211/50 |
| 4,871,218 | 10/1989 | Swinson | 211/55 X |
| 5,094,349 | 3/1992 | DeVito | 211/50 |

FOREIGN PATENT DOCUMENTS 6631086 7/1989 Australia .

*Primary Examiner*—Robert W. Gibson, Jr.

*Attorney, Agent, or Firm*—Brown, Martin, Haller & McClain

[57] ABSTRACT

A modular display apparatus for advertising material comprising a plurality of interconnecting modular receptacles (10), each being of approximately rectangular shape and having a base wall (11), vertical side walls (14), front and rear walls (12, 13) spaced apart by the base wall (14) and an open upper end, said walls defining a compartment into which sheet material can be inserted through said open upper end, said front wall (12) having a transverse horizontal edge (23) spaced a short distance from the base wall, said rear wall having connection means (20) projecting therefrom near said upper end and which defines with the outer face of the rear wall (13) a transverse downwardly-directed slot (22) for slidably receiving and frictionally retaining the transverse horizontal edge (23) of the front wall of an adjacent receptacle positioned therebehind in overlapping relationship.

8 Claims, 3 Drawing Sheets

DISPLAY APPARATUS

BACKGROUND OF THE INVENTION

This invention relates to a modular display system for displaying products such as brochures, leaflets, and other like advertising material.

Retail outlets, the travel and hotel industry, the real estate industry, educational institutions, and service industries (e.g. libraries, local councils, government departments and financial institutions) require display apparatus that is easy to assemble, adaptable, and holds display material neatly in place, whilst allowing such material to be readily removed by the customer. It is an object of the present invention to provide such display apparatus.

Various modular display systems have been devised in the past. However, these all suffer from one or more of the following disadvantages: too expensive, lack of adaptability, too difficult to assemble, or not holding display materials sufficiently neatly.

BRIEF SUMMARY OF THE INVENTION

The present invention provides a modular display apparatus for advertising material comprising a plurality of interconnecting modular receptacles, each being of approximately rectangular shape and having a base wall , vertical side walls, front and rear walls spaced apart by the base wall and an open upper end, said walls defining a compartment into which sheet material can be inserted through said open upper end, said front wall having a transverse horizontal edge spaced a short distance from the base wall, said rear wall having connection means projecting therefrom near said upper end and which defines with the outer face of the rear wall a transverse downwardly-directed slot for slidably receiving and frictionally retaining the transverse horizontal edge of the front wall of an adjacent receptacle positioned therebehind in overlapping relationship.

In this way, a plurality of display receptacles can be connected together one behind another to form an upright row to in turn form the display apparatus for receiving products to be displayed.

Preferably, the rear wall is provided with mounting means adjacent its upper end, above said connecting means for removably attaching the receptacle to a support surface.

Alternatively, the receptacle can be free-standing by means of a separate base bracket releasably attachable to the rear wall adjacent its bottom edge.

Preferably, the connection means comprises two transversely spaced apart downwardly directed resilient deflectable lugs or tabs arranged to lockingly engage over said transverse horizontal edge.

Preferably, abutment means are provided on the rear wall, against which the lower edge of the front wall of an adjacent receptacle abuts, when the receptacles are connected. This minimises the likelihood of the receptacles detaching from one another when in use.

Preferably, the modules are injection moulded of a suitable plastics material, eg acrylic.

DETAILED DESCRIPTION OF THE INVENTION

A preferred embodiment of the invention will now be described by way of example only, and with reference to the accompanying drawings, in which:

FIGS. 1(*a*), (*b*) are front and rear perspective views of a display unit according to the invention;

Figure 1B:
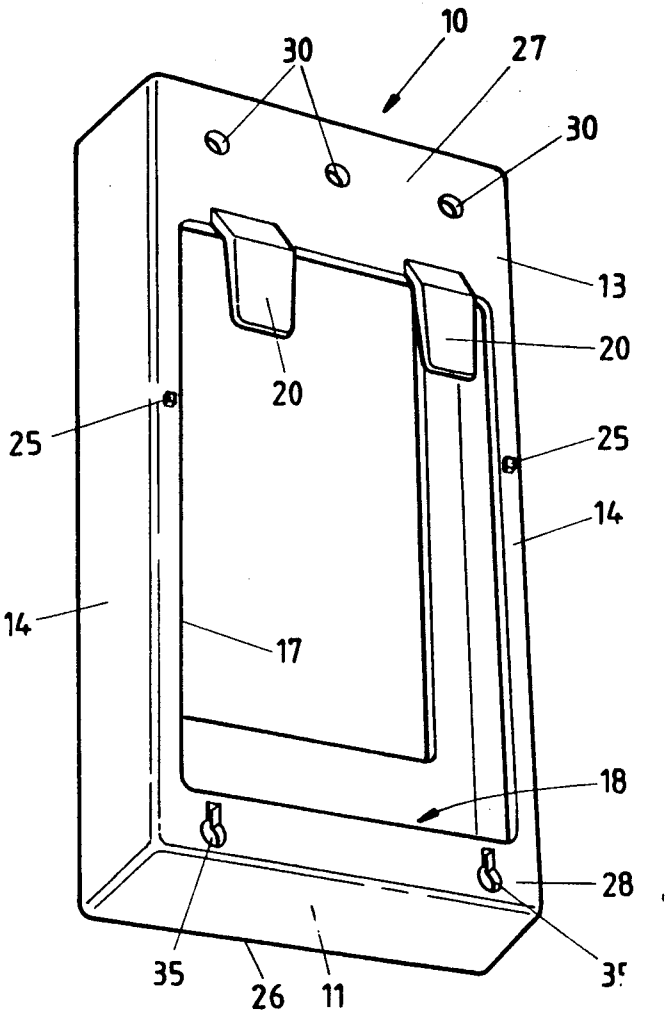
Figure 1A:
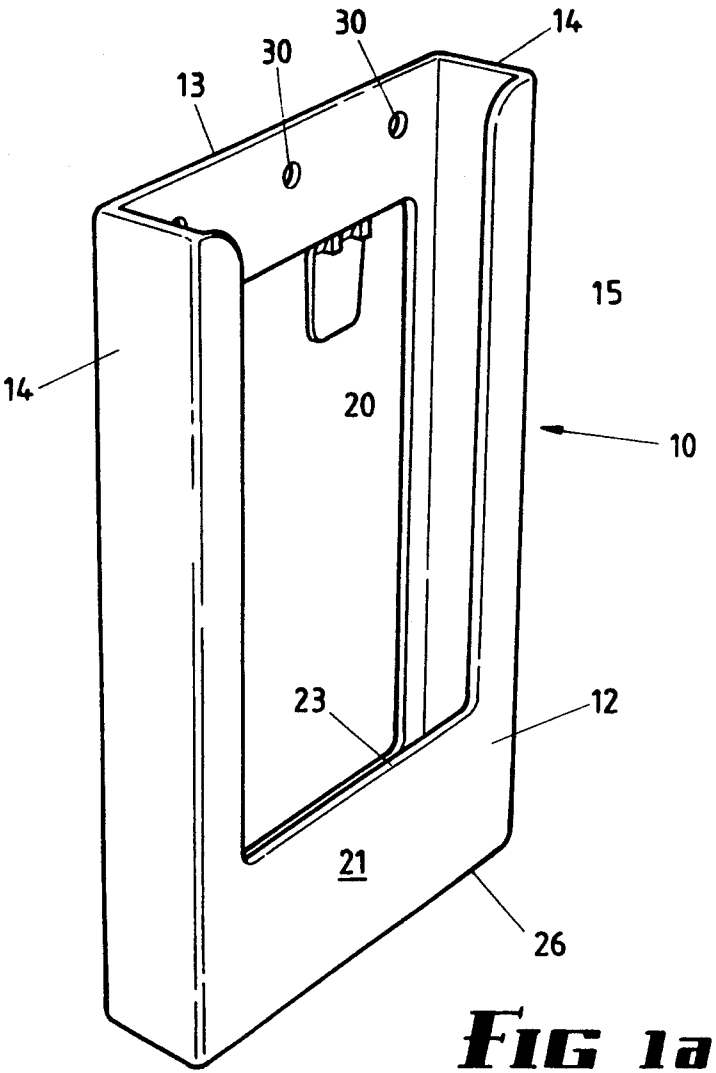
Figure 3:
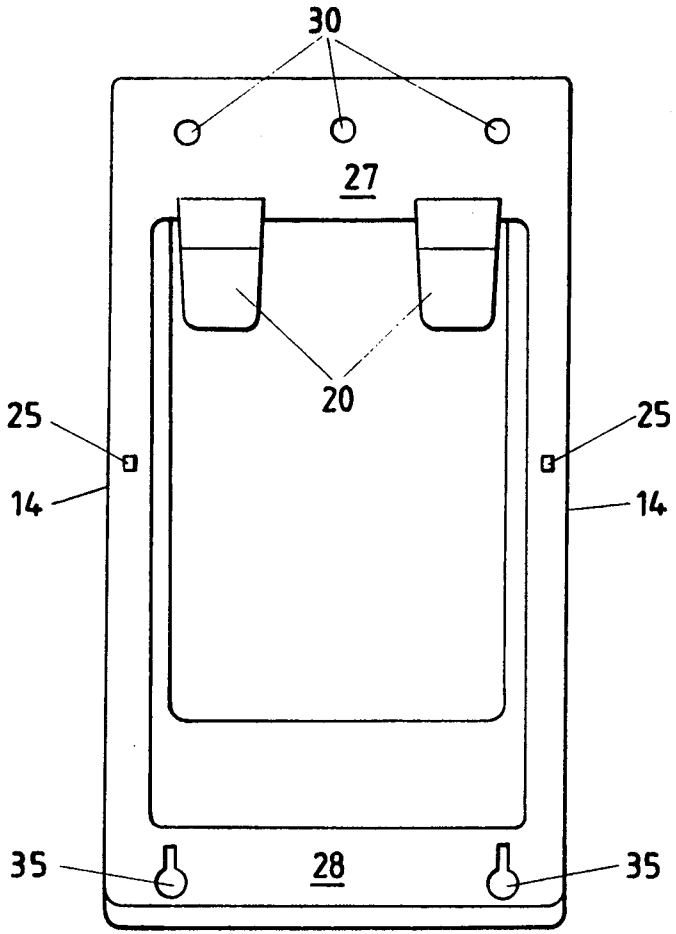
FIG. 3 is a rear view of the display unit shown in FIG. 1.
Figure 2:
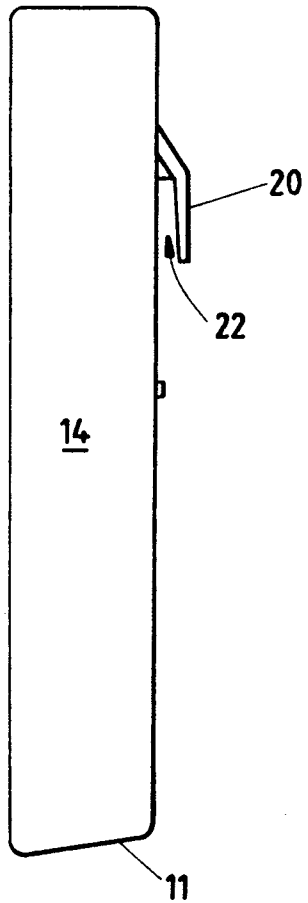
FIG. 2 is a side elevational view of the display unit shown in FIG. 1.
Figure 5:
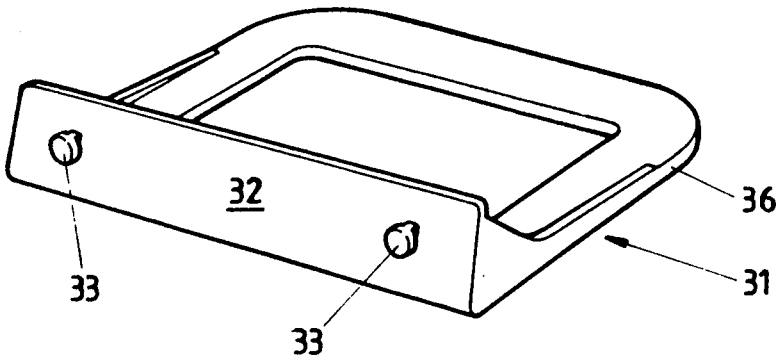
FIG. 5 is a perspective view of a base bracket shown in FIG. 4.

With reference to FIGS. 1–3, a modular display unit comprises an integrally moulded approximately rectangular receptacle 10 comprising a base wall 11, a front wall 12, a rear wall 13 and opposite vertical side walls 14, with an open upper end. The front wall 12 is provided with a rectangular opening 15 extending inwardly from its upper edge, whilst the rear wall 13 has a rectangular window 17 formed therein. The opening 15 has a length which is approximately three-quarters of the length of the receptacle 10, whilst the window 17 has an area which is greater than ½ of the area of the rear wall. The receptacle 10 is designed to slidably receive (through its open upper end) and hold display material upright by supporting the material along their side margins, the bottom margins of the material being supported in the upwardly open support channel 18 extending across the width of the receptacle 10 at its lower end, whilst allowing a large proportion of each different brochure etc to be shown when the receptacles are used together in multiples (as shown in FIG. 4).

To enable the receptacles 10 to be clipped to one another, the rear wall 13 of each unit is provided with a pair of offset depending transversely spaced apart resilient lugs or tabs 20 which form, with the rear wall 13, a transverse slot 22 which is arranged to slidably receive a portion 21 of front wall 12 of an adjacent unit 10, with the lugs 20 hookingly engaging over transverse edge 23 of the front wall 12. The width of the slot 22 narrows inwardly (refer FIG. 2) such that when the edge 23 is inserted therein, the wall portion 21 is retained by frictional engagement with the inner faces of the lugs 20. The lugs 20 are resilient and hence can deflect as the wall portion 21 is inserted into the slot 22.

Figure 4:
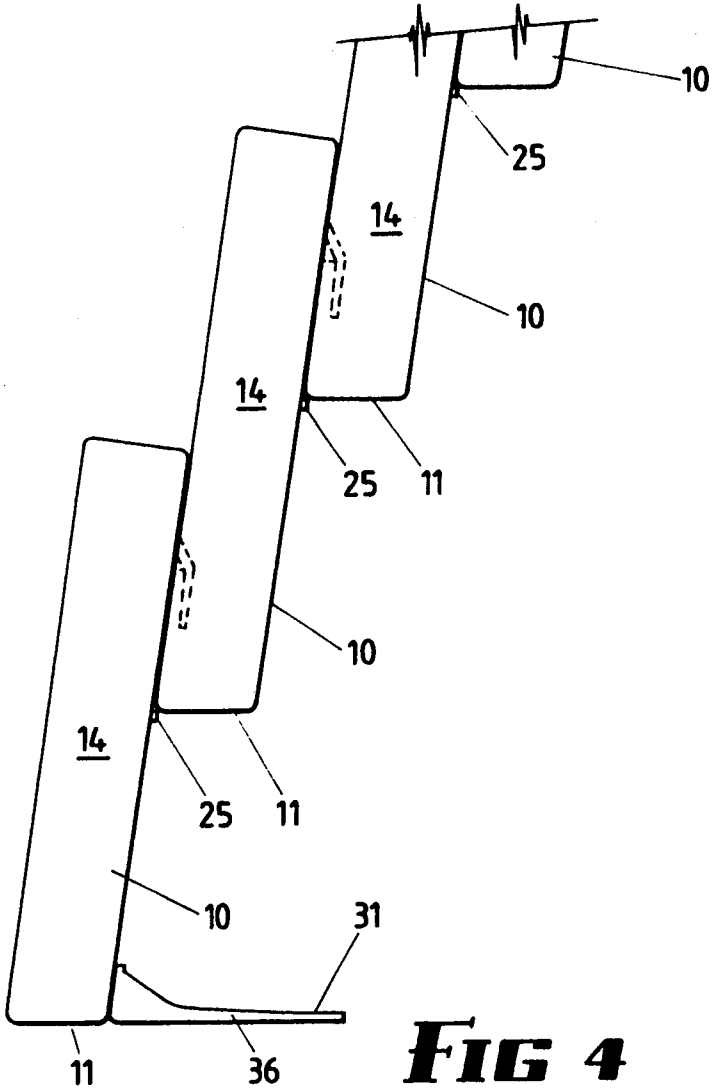
FIG. 4 is a side view of a plurality of units clipped together to form a tiered free standing display.

To further minimise the separation of the modules 10, when clipped together, the rear wall 13 of each unit 10 is provided with a pair of transversely aligned protrusions 25, one adjacent each of its vertical margins, the protrusions 25 being arranged to abut against the lower front edge 26 of an adjacent module 10 from which the first module 10 is suspended (refer FIG. 4). The resilience of the lugs 20 permits relative deflection of the modules 10 during attachment so that the protrusions 25 can slide downwardly across wall portions 21 and "click" into position when the lugs 20 are fully engaged.

The rear wall 13 consists of upper and lower transversely extending wall panel portions 27, 28 which interconnect the side walls 14, the wall portion 28 having a height which is less than that of wall portion 27. The upper wall portion 27 is provided with a plurality of transversely spaced mounting holes 30 adjacent its upper edge, whereby the module 10 is able to be secured to a support surface, eg a wall or a display stand, by means of screws or similar fasteners. With the module so secured, other modules 10 are then hung from each other in overlapping relationship as shown in FIG. 4 to form the display apparatus.

The modules 10 may also be assembled together as a free standing display unit. This can be achieved by means of a base support bracket 31 which detachably connects to the lower wall portion 28 of the lowermost module 10 by means of key formations 33 which project from an upstanding flange 32 and which lockingly engage in key-hole openings 35 formed in the wall portion 28. The flange 32 connects to a horizontal base 36, which serves to support the vertically aligned modules 10 in an upright condition. The bracket 31 is located in position by firstly inserting the formations 33 through the circular portions of the openings 35 and then sliding the bracket 31 upwards so that the formations 33 look into the narrow section of the openings 35.

The display units clip together to form a robust, continuous display which can be wall-mounted, or mounted on a display stand which is free-standing or placed on a counter as a free standing display. Alternatively, a single support bracket, which can be fastened to a wall or made free-standing, may be used to support a row of units, centrally thereof, the support bracket having a vertical leg portion which merges with a downwardly and forwardly inclined portion which in turn terminates in a rearwardly directed base portion. The uppermost vertically disposed unit is arranged to bear against the vertical leg portion of the bracket, whilst the successively lower units each have bottom rear edge portions contacting the inclined portion of the bracket at spaced intervals therealong. The bracket may be formed from a length of metal strip.

The display units are preferably injection moulded of plastics material, eg acrylic, but may however be manufactured from sheet metal.

Instead of the modules being clipped together to form a single upright row, they can be transversely offset, so that each module is hung from two horizontally aligned upper modules. The modules can thus be assembled together in different arrays.

The display units can be manufactured in any suitable size, eg envelope size (⅓ A4), A4 and A5.

While the present invention has been described in terms of preferred embodiments in order to facilitate better understanding of the invention, it should be appreciated that various modifications can be made without departing from the principle of the invention. Therefore, the invention should be understood to include all such modifications within its scope.

I claim:

1. Display apparatus for advertising sheet material such as brochures, leaflets, comprising a plurality of integrally formed modular receptacles arranged for interconnection, front to back, in staggered or stepped relation, each receptacle being of approximately rectangular shape and having a base wall, side walls, front and rear walls spaced apart by the base wall, and an open upper end, said walls defining a pocket-like compartment into which sheet material can be inserted through said open upper end, said front wall having inner peripheral edges defining a window opening extending inwardly from said open upper end, the bottom edge of said opening being a transverse horizontal edge formed near the base wall, connecting means near the upper end of said rear wall and projecting therefrom, said connecting means and the outer face of the rear wall defining therebetween a transverse downwardly-directed slot for slidably receiving and frictionally retaining the transverse horizontal edge of the front wall of an adjacent receptacle to thereby effect said interconnection with an upper portion of the rear wall of the front receptacle in abutting relation with a lower portion of the front wall of an adjacent receptacle therebehind.

2. Display apparatus according to claim 1 wherein said connecting means comprises a pair of transversely spaced, downwardly directed deflectable resilient locking lugs or tabs.

3. Display apparatus according to claim 2 further comprising abutment means on said rear wall below said lugs or tabs, said abutment means being arranged to abuttingly engage against the lower edge of the front wall of an adjacent interconnected receptacle, whereby relative parallel sliding movement between said adjacent receptacles, is inhibited.

4. Display apparatus according to claim 3 wherein said abutment means comprises a pair of horizontally aligned transversely spaced protrusions, one adjacent each vertical margin of the rear wall.

5. Display apparatus according to claim 2 wherein said rear wall comprises upper and lower transverse wall portions extending between said side walls, a rectangular shaped opening formed between said upper and lower wall portions and having an area which is greater than one half of the area of the rear wall, said depending lugs or tabs projecting downwardly from the lower edge of said upper wall portion.

6. Display apparatus according to claim 5 wherein said upper wall portion comprises a plurality of horizontally aligned mutually spaced holes adjacent its upper edge to enable the receptacle to be mounted by means of fasteners to a support surface.

7. Display apparatus according to claim 1 further comprising a base support bracket, and connection means for detachably mechanically interconnecting the base support bracket and the rear wall of the lower most receptacle adjacent its lower edge, the base support bracket being arranged to support the display apparatus in a free-standing rearwardly tilted position.

8. Display apparatus according to claim 1 wherein the length of the opening is greater than half the overall height of the receptacle.

* * * * *